US005691292A

United States Patent [19]

Marshall et al.

[11] Patent Number: 5,691,292

[45] Date of Patent: Nov. 25, 1997

[54] THIXOTROPIC LIQUID AUTOMATIC DISHWASHING COMPOSITION WITH ENZYME

[75] Inventors: Janet Layne Marshall, Wyoming, Ohio; David Lee Hall, Covington, Ky.; Hal Ambuter, Medina; Edward Paul Fitch, Cincinnati, both of Ohio

[73] Assignee: The Procter & Gamble Company, Cincinnati, Ohio

[21] Appl. No.: 518,064

[22] Filed: Aug. 22, 1995

Related U.S. Application Data

[63] Continuation-in-part of Ser. No. 149,172, Nov. 8, 1993, abandoned, which is a continuation of Ser. No. 867,575, Apr. 13, 1992, abandoned.

[51] Int. Cl.[6] ..... C11D 3/386; C11D 3/37

[52] U.S. Cl. ..... 510/221; 510/223; 510/226; 510/227; 510/228; 510/392; 510/477

[58] Field of Search ..... 510/221, 223, 510/226, 227, 228, 392, 477

[56] References Cited

U.S. PATENT DOCUMENTS

| | | | |
|---|---|---|---|
| 4,101,457 | 7/1978 | Place et al. | 252/559 |
| 4,162,987 | 7/1979 | Maguire, Jr. et al. | 252/135 |
| 4,537,707 | 8/1985 | Severson, Jr. et al. | 252/545 |
| 4,573,748 | 3/1986 | Laiken et al. | 252/99 |
| 4,740,327 | 4/1988 | Julemont et al. | 252/103 |
| 4,810,413 | 3/1989 | Pancheri et al. | 252/124.12 |
| 4,836,948 | 6/1989 | Corring | 252/99 |
| 4,917,812 | 4/1990 | Cilley | 252/99 |
| 4,941,988 | 7/1990 | Wise | 259/99 |
| 4,959,179 | 9/1990 | Aronson et al. | 252/135 |
| 4,968,446 | 11/1990 | Ahmed et al. | 252/99 |
| 5,053,158 | 10/1991 | Dixit et al. | 252/99 |
| 5,064,553 | 11/1991 | Dixit et al. | 252/94 |
| 5,084,198 | 1/1992 | Ahmed et al. | 252/99 |
| 5,094,771 | 3/1992 | Ahmed et al. | 252/99 |
| 5,124,066 | 6/1992 | Russell | 252/174.12 |
| 5,130,043 | 7/1992 | Prince et al. | 252/95 |
| 5,141,664 | 8/1992 | Corring et al. | 252/90 |
| 5,160,448 | 11/1992 | Corring et al. | 252/95 |
| 5,368,766 | 11/1994 | Dixit et al. | 252/94 |
| 5,413,727 | 5/1995 | Drapier et al. | 252/97 |
| 5,510,047 | 4/1996 | Gabriel et al. | 252/89.1 |

FOREIGN PATENT DOCUMENTS 9321299 10/1993 WIPO .

*Primary Examiner*—Douglas J. McGinty
*Assistant Examiner*—Kery Fries
*Attorney, Agent, or Firm*—Michael D. Jones; Brian M. Bolam; Kim William Zerby

[57] ABSTRACT

A viscoelastic, thixotropic, liquid automatic dishwashing detergent composition which is substantially free of chlorine bleach and silicate and contains enzyme(s), an enzyme stabilizing system, and a detergent surfactant or detergent builder is provided. It has a product pH between about 7 and about 11.

20 Claims, No Drawings

THIXOTROPIC LIQUID AUTOMATIC DISHWASHING COMPOSITION WITH ENZYME

This is a continuation-in-part of application Ser. No. 08/149,172, filed on Nov. 8, 1993, now abandoned, which is a continuation of application Ser. No. 07/867,575, filed on Apr. 13, 1992, now abandoned.

BACKGROUND OF THE INVENTION

Technical Field

The present invention relates to a viscoelastic, thixotropic, liquid automatic dishwashing detergent composition which is substantially free of chlorine bleach, clay thickeners, and silicate. The automatic dishwashing composition contains enzyme, an enzyme stabilizing system, and detergent surfactant or detergent builder. It has a product pH between about 7 and about 11.

Because of their convenience, dispensing characteristics and aesthetics, liquid and/or gel automatic dishwashing detergent compositions are becoming an increasingly popular alternative to granular compositions among consumers. However, liquid and/or gel formulations often do not deliver the same effective cleaning, spotting and filming performance as a granular composition.

To clean effectively, liquid/gel and granular automatic dishwashing detergents contain chlorine bleach and have high alkalinity (i.e. silicate, carbonate and caustic). See, for example, U.S. Pat. Nos. 4,116,849, Leikhim, issued Sep. 26, 1978, 5,064,553, Dixit et al, issued Nov. 12, 1991 and 4,917,812, Cilley, issued Apr. 17, 1990. Incorporation of chlorine bleaches requires special processing and storage steps to protect detergent composition components which are subject to deterioration upon contact with active chlorine. Automatic detergent compositions have been disclosed which use enzymes in place of chlorine bleach, for example, U.S. Pat. Nos. 4,162,987, Maguire et al, issued Jul. 31, 1979, 4,101,457, Place et al, issued Jul. 18, 1978 and 5,075,027, Dixit et al, issued Dec. 24, 1991.

It has been found that a viscoelastic thixotropic liquid automatic dishwashing detergent can be formed with performance equal to or better than that of comparable granular products. Surprisingly, a low alkaline product pH (between about 7 and about 11) liquid composition which is substantially free of chlorine and silicate exhibits enhanced cleaning, spotting and filming ability. The cleaning benefit is achieved via the presence of enzymes and surfactant and/or builder in the composition. Removal of chlorine bleach and a lower product pH results in a composition which is safer to dishwasher articles (i.e. china, silverware, glass, and the like). Also, it has now been found that a viscoelastic, thixotropic, liquid automatic dishwashing detergent composition which is substantially free of chlorine bleach and silicate, and which contains enzymes and citrate, can provide performance benefits equal to or better than granular detergent compositions containing bleach, silicate and phosphate. The replacement of phosphate as the builder of choice with citrate or citric acid results in additional dishwasher article safety.

SUMMARY OF THE INVENTION

The composition of this invention is a viscoelastic, thixotropic, liquid automatic dishwashing detergent composition comprising, by weight:

(a) from about 0.001% to about 5% of active detersive enzyme or enzymes;

(b) from about 0.1% to about 10% of a viscoelastic, thixotropic thickener;

(c) from about 0.001% to about 10% of an enzyme stabilizing system selected from the group consisting of calcium ion, propylene glycol, short chain carboxylic acid, polyhydroxyl compounds, boric acid, boronic acid and mixtures thereof;

(d) from about 0.01% to about 40% of a detergent surfactant or a detergent builder or mixtures thereof; and (d) sufficient pH adjusting agent to provide said composition with a product pH between about 7 and about 11; wherein said composition is substantially free of chlorine bleach, clay thickeners, and silicate.

A particularly preferred embodiment of this invention is a gel automatic dishwashing detergent composition further comprising, by weight, from about 0.01% to about 6% of a chlorine scavenger.

DETAILED DESCRIPTION OF THE INVENTION

The present invention encompasses viscoelastic, thixotropic, liquid automatic detergent compositions which exhibit enhanced cleaning performance in the absence of chlorine bleach and silicate. These detergent compositions contain the following components by weight of the composition:

(1) from about 0.001% to about 5% of an active detersive enzyme;

(2) from about 0.1% to about 10% of a viscoelastic, thixotropic thickener;

(3) from about 0.001% to about 10% of an enzyme stabilizing system selected from the group consisting of calcium ion, propylene glycol, short chain carboxylic acid, boric acid, boronic acid, polyhydroxyl compounds and mixtures thereof;

(4) from about 0.01% to about 40% of a detergent surfactant or a detergent builder or mixtures thereof; and (5) sufficient pH adjusting agent to provide a viscoelastic thixotropic liquid automatic dishwashing detergent with a product pH between about 7 and about 11. Various other optional ingredients, such as fatty acids, oxygen bleaches, perfumes, dyes, suds control agents and organic dispersants, can be added to provide additional performance and aesthetic benefits.

These components result in a viscoelastic, thixotropic, liquid automatic dishwashing detergent composition which exhibits cleaning, spotting and filming performance equal to or better than analogous granular automatic dishwashing detergent compositions. A particularly preferred composition is a gel formulation.

The term thixotropic means the material exhibits a decrease in viscosity with increasing shear. In other words it exhibits high viscosity when subjected to low stress and lower viscosity when subjected to high stress. A viscoelastic liquid exhibits a steady state flow behaviour after a constant stress has been applied for a sufficiently long period of time.

Detersive Enzyme

The compositions of this invention contain from about 0.001% to about 5%, more preferably from about 0.003% to about 4%, most preferably from about 0.005% to about 3 %, by weight, of active detersive enzyme.

The preferred detersive enzyme is selected from the group consisting of protease, amylase, lipase and mixtures thereof. Most preferred are protease or amylase or mixtures thereof.

The proteolytic enzyme can be of animal, vegetable or microorganism (preferred) origin. More preferred is serine proteolytic enzyme of bacterial origin. Purified or nonpurified forms of this enzyme may be used. Proteolytic enzymes produced by chemically or genetically modified routants are included by definition, as are close structural enzyme variants. Particularly preferred is bacterial serine proteolytic enzyme obtained from Bacillus, *Bacillus subtilis* and/or *Bacillus licheniformis*.

Suitable proteolytic enzymes include Alcalase®, Esperase®, Savinase® (preferred); Maxatase®, Maxacal® (preferred), and Maxapem® 15 (protein engineered Maxacal); and subtilisin BPN and BPN' (preferred); which are commercially available. Preferred proteolytic enzymes are also modified bacterial serine proteases, such as those described in European Patent Application Serial Number 87 303761.8, filed Apr. 28, 1987 (particularly pages 17, 24 and 98), and which is called herein "Protease B", and in European Patent Application 199,404, Venegas, published Oct. 29, 1986, which refers to a modified bacterial serine proteolytic enzyme which is called "Protease A" herein. Preferred proteolytic enzymes, then, are selected from the group consisting of Savinase®, Esperase®, Maxacal®, BPN, Protease A and Protease B, and mixtures thereof. Esperase® is most preferred.

Suitable lipases for use herein include those of bacterial, animal, and fungal origin, including those from chemically or genetically modified routants.

Suitable bacterial lipases include those produced by Pseduomonas, such as *Pseudomonas stutzeri* ATCC 19,154, as disclosed in British Patent 1,372,034, incorporated herein by reference. Suitable lipases include those which show a positive immunological cross-reaction with the antibody of the lipase produced the the microorganism *Pseudomonas fluorescens* IAM 1057. This lipase and a method for its purification have been described in Japanese Patent Application 53-20487, laid open on Feb. 24, 1978, which is incorporated herein by reference. This lipase is available under the trade name Lipas P "Amano," hereinafter referred to as "Amano-P." Such lipases should show a positive immunological cross reaction with the Amano-P antibody, using the standard and well-known immunodiffusion procedure according to Oucheterlon (Acta. Med. Scan., 133, pages 76–79 (1950)). These lipases, and a method for their immunological cross-reaction with Amano-P, are also described in U.S. Pat. No. 4,707,291, Thom et al., issued Nov. 17, 1987, incorporated herein by reference. Typical examples thereof are the Amano-P lipase, the lipase ex *Pseudomonas fragi* FERM P 1339 (available under the trade name Amano-B), lipase ex *Pseudomonas nitroreducens* var. *lipolyticum* FERM P 1338 (available under the trade name Amano-CES), lipases ex *Chromobacter viscosum* var. *lipolyticum* NRRlb 3673, and further *Chromobacter viscousm* lipases, and lipases ex *Pseudomonas gladloli*. Other lipases of interest are Areario AKG and Bacillis Sp lipase (e.g. Solvay enzymes).

Other lipases which are of interest where they are compatible with the composition are those described in EP A 0 339 681, published Nov. 28, 1990, EP A 0 385 401, published Sep. 5, 1990, EO A 0 218 272, published Apr. 15, 1987, and PCT/DK 88/00177, published May 18, 1989, all incorporated herein by reference.

Suitable fungal lipases include those produced by *Humicola lanuginosa* and *Thermomyces lanuginosus*. Most preferred is lipase obtained by cloning the gene from *Humicola lanuginosa* and expressing the gene in *Aspergillus oryzae* as described in European Patent Application 0 258 068, incorporated herein by reference, commercially available under the trade name Lipolase® from Novo-Nordisk.

Any amylase suitable for use in a liquid detergent composition can be used in these compositions. Amylases include for example, a-amylases obtained from a special strain of *B. licheniforms*, described in more detail in British Patent Specification No. 1,296,839. Amylolytic enzymes include, for example, Rapidase™, Maxamyl™, Termamyl™ and BAN™.

In a preferred embodiment, from about 0.001% to about 5%, preferably 0.005% to about 3%, by weight of active amylase can be used. Preferably from about 0.005% to about 3 % by weight of active protease can be used. Preferably the amylase is Maxamyl™ and/or Termanyl™ and the protease is Esperase® and/or Savinase®.

Thickening Agent

The viscoelastic, thixotropic thickening agent in the compositions of the present invention is from about 0.1% to about 10%, preferably from about 0.25% to about 5%, most preferably from about 0.5% to about 3%, by weight of the detergent composition. Preferably, the viscoelastic, thixotropic thickening agent is free of any enzymatically reactive species. Without being bound by theory, it is believed that the enzyme(s) present in the automatic detergent composition could degrade the thickening agent which contains such species, resulting in a theologically unstable product.

Preferably the thickening agent is a polymer with a molecular weight from about 500,000 to about 10,000,000, more preferably from about 750,000 to about 4,000,000.

The preferred cross-linked polycarboxylate polymer is preferably a carboxyvinyl polymer. Such compounds are disclosed in U.S. Pat. No. 2,798,053, issued on Jul. 2, 1957, to Brown, the specification of which is hereby incorporated by reference. Methods for making carboxyvinyl polymers are also disclosed in Brown. Carboxyvinyl polymers are substantially insoluble in liquid, volatile organic hydrocarbons and are dimensionally stable on exposure to air.

Preferred polyhydric alcohols used to produce carboxyvinyl polymers include polyols selected from the class consisting of oligosaccarides, reduced derivatives thereof in which the carbonyl group is converted to an alcohol group, an pentaerythritol; most preferred is sucrose or pentaerythritol. It is preferred that the hydroxyl groups of the modified polyol be etherified with alkyl groups, the polyol having at least two allyl ether groups per polyol molecule. When the polyol is sucrose, it is preferred that the sucrose have at least about five allyl ether groups per sucrose molecule. It is preferred that the polyether of the polyol comprise from about 0.1% to about 4% of the total monomers, more preferably from about 0.2% to about 2.5%.

Preferred monomeric olefinically unsaturated carboxylic acids for use in producing carboxyvinyl polymers used herein include monomeric, polymerizable, alpha-beta monoolefinically unsaturated lower aliphatic carboxylic acids; more preferred are monomeric monoolefinic acrylic acids of the structure

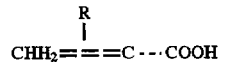

where R is a substituent selected from the group consisting of hydrogen and lower alkyl groups; most preferred is acrylic acid.

Various carboxyvinyl polymers, homopolymers and copolymers are commercially available from B. F. Goodrich Company, New York, N.Y., under the trade name CarbopolR. These polymers are also known as carbomers or polyacrylic acids. Carboxyvinyl polymers useful in formulations of the present invention include Carbopol 910 having a molecular weight of about 750,000, Carbopol 941 having a molecular weight of about 1,250,000, and Carbopols 934 and 940 having molecular weights of about 3,000,000 and 4,000,000, respectively. More preferred are the series of Carbopols which use ethyl acetate and cyclohexane in the manufacturing process, Carbopol 981, 2984, 980, and 1382.

Preferred polycarboxylate polymers of the present invention are non-linear, water-dispersible, polyacrylic acid cross-linked with a polyalkenyl polyether and having a molecular weight of from about 750,000 to about 4,000,000.

Highly preferred examples of these polycarboxylate polymers for use in the present invention are Sokalan PHC-25®, a polyacrylic acid available from BASF Corporation, the Carbopol 600 series resins available from B. F. Goodrich, and more preferred is Polygel DK available from 3-V Chemical Corporation. Mixtures of polycarboxylate polymers as herein described may also be used in the present invention.

The polycarboxylate polymer thickening agent is preferably utilized with essentially no clay thickening agents since the presence of clay usually results in a less desirable product having phase instability. In other words, the polycarboxylate polymer is preferably used instead of clay as a thickening agent in the present compositions.

Other types of thickeners which can be used in this composition include natural gums, such as xanthan gum, locust bean gum, guar gum, and the like. The cellulosic type thickeners: hydroxyethyl and hydroxymethyl cellulose (ETHOCEL and METHOCEL® available from Dew Chemical) can also be used.

In the preferred viscoelastic thixotropic liquid automatic dishwashing detergent composition, the polycarboxylate polymer thickening agent provides an apparent viscosity at high shear of greater than about 250 centipoise and an apparent yield value of from about 40 to about 800, and most preferably from about 60 to about 600, dynes/cm$^2$ to the composition.

Viscosity is a measure of the internal resistance to flow exhibited by a fluid in terms of the ratio of the shear stress to the shear rate. The yield value is an indication of the shear stress at which the gel strength is exceeded and flow is initiated. Yield value can be measured herein with a Brookfield RVT model viscometer with a T-bar B spindle at about 77° F. (25° C.) utilizing a Helipath drive during associated readings. The system is set to 0.5 rpm and a torque reading is taken for the composition to be tested after 30 seconds or after the system is stable. The system is stopped and the rpm is reset to 1.0 rpm. A torque reading is taken for the same composition after 30 seconds or after the system is stable. Apparent viscosities are calculated from the torque readings using factors provided with the Brookfield viscometer. An apparent Brookfield yield value is then calculated as: Brookfield Yield Value=(apparent viscosity at 0.5 rpm—apparent viscosity at I rpm)/100. This is the common method of calculation, published in Carbopol literature from the B. F. Goodrich Company and in other published references. In the cases of most of the formulations quoted herein, this apparent yield value is approximately four times higher than yield values calculated from shear rate and stress measurements in more rigorous rheological equipment.

Apparent viscosities at high shear are determined with a Brookfield RVT viscometer with spindle #6 at 100 rpm, reading the torque at 30 seconds.

A preferred method herein for measuring viscosity and yield value is with a Contrayes Rheomat 115 viscometer which utilizes a Rheoscan 100 controller, a DINI 45 spindle and cup at 25° C. For viscosity measurements, the shear rate is increased from 0 to 150 sec-1 over a 30 second time period. The viscosity, measured in centipoise, is taken at a shear rate of 150 sec-1. The shear rate for yield value measurements is increased linearly from 0 to 0.4 sec-1 over a period of 500 seconds after an initial 5 minute rest period.

Enzyme Stabilizing System

The preferred compositions herein comprise from about 0.001% to about 10%, preferably from about 0.005% to about 8%, most preferably from about 0.01% to about 6%, by weight, of an enzyme stabilizing system. The enzyme stabilizing system can be any stabilizing system which is compatible with the enzyme of the present invention. Such stabilizing systems can comprise calcium ion, boric acid, propylene glycol, short chain carboxylic acid, boronic acid, polyhydroxyl compounds and mixtures thereof. The level of calcium ion should be selected so that there is always some minimum level available for the enzyme, after allowing for complexation with builders, etc., in the composition. Any water-soluble calcium salt can be used as the source of calcium ion, including calcium chloride, calcium formate, and calcium acetate. A small amount of calcium ion, generally from about 0.05 to about 0.4 millimoles per liter, is often also present in the composition due to calcium in the enzyme and formula water. Calcium ions can be used with boric acid or a suitable salt of boric acid, described herein below, in a composition with a product pH between about 7 and about 9. However, calicum ions and the salt of boric acid can associate to form calcium borate which is insoluble in cold water and under certain product conditions can be insoluble above about pH 9. This precipitate can lead to phase instability, decrease in effective enzyme stabilization and undesired product aesthetics. Therefore, a sufficient amount of calcium ion and boric acid or the salt of boric acid should be used to achieve enzyme stability without affecting phase stability, enzyme stability, or aesthetics. From about 0.03% to about 0.6%, more preferably from about 0.05% to about 0.45 % of calcium formate is preferred.

Other suitable enzyme stabilizing systems comprise polyols containing only carbon, hydrogen and oxygen atoms. They preferably contain from about 2 to about 6 carbon atoms and from about 2 to about 6 hydroxy groups. Examples include propylene glycol (especially 1,2-propanediol, which is preferred), 1,2- butanediol, ethylene glycol, glycerol, sorbitol, mannitol, and glucose. The polyol generally represents from about 0.5% to about 10%, preferably from about 1.5% to about 8%, by weight of the composition. Preferably, the weight ratio of polyol to a boric acid added is at least 1, most preferably at least about 1.3.

The compositions can also contain the water-soluble short chain carboxylates described in U.S. Pat. No. 4,318,818, Letton et at., issued Mar. 9, 1982, incorporated herein by reference. The formates are preferred and can be used at levels from about 0.05% to about 5%, preferably from about 0.075% to about 2.5%, most preferably from about 0.1% to about 1.5%, by weight. Sodium formate is preferred.

Another stabilizing system comprises from about 0.05% to about 7%, preferably from about 0.1% to about 5%, by weight of boric acid. The boric acid may be, but is preferably not, formed by a compound capable of forming boric acid in the composition. Boric acid is preferred, although other compounds such as boric oxide, borax and other alkali metal borates (e.g., sodium ortho-, meta- and pyroborate, and sodium pentaborate) are suitable.

Still another enzyme stabilizing system includes polyhydroxyl compounds, such as sugar alcohols, monosaccharides and discaccharides as disclosed in the specification of German Pat. No. 2,038,103, water-soluble sodium or potassium salts and water-soluble hydroxy alcohols, as disclosed in U.S. Published Patent Application B-458,819, Weber, published Apr. 13, 1976; aliamines and polyamines, as disclosed in German Pat. No. 2,058,826; amino acids, as disclosed in German Pat. No. 2,060,485; and reducing agents, as disclosed in Japanese Pat. No. 72-20235. Further, in order to enhance its storage stability, the enzyme mixture may be incorporated into the detergent composition in a coated, encapsulated, agglomerated, prilled, or noodled form in accordance with, e.g., U.S. Pat. No. 4,162,987, Maguire et al, issued Jul. 31, 1979.

Substituted boric acids (e.g. phenylboronic acid, butane boronic acid, and p-bromo phenylboronic acid) can also be used in place of boric acid. A particularly preferred boronic acid is an aryl boronic acid of the structure:

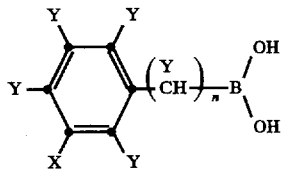

where x is selected from $C_1$-$C_6$ alkyl, substituted $C_1$-$C_6$ alkyl, aryl, substituted aryl, hydroxyl, hydroxyl derivative, amine $C_1$-$C_6$ alkylated amine, amine derivative, halogen, nitro, thiol, thio derivative, aldehyde, acid, acid salt, ester, sulfonate or phosphonate; each Y is independently selected from hydrogen, $C_1$-$C_6$ alkyl, substituted $C_1$-$C_6$ alkyl, aryl, substituted aryl, hydroxyl, hydroxyl derivative, halogen, amine, alkylated amine, amine derivative, nitro, thiol, thiol, thiol, derivative, aldehyde, acid, ester, sulfonate or phosphonate; and n is 0 to 4.

In addition to the above listed enzyme stabilizers, from 0 to about 10%, preferably from about 0.01% to about 6% by weight, of chlorine bleach scavengers can be added to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of of water that comes in contact with the enzyme during dishwashing is usually large; accordingly, enzyme stability in-use can be problematic.

Suitable chlorine scavenger anions are salts containing ammonium cations. These can be selected from the group consisting of reducing materials like sulfite, bisulfite, thiosulfite, thiosulfate, iodide, etc., antioxidants like carbamate, ascorbate, etc., organic amines such as ethylenediaminetetracetic acid (EDTA) or alkali metal salt thereof and monoethanolamine (MEA), and mixtures thereof. Other conventional scavenging anions like sulfate, bisulfate, carbonate, bicarbonate, percarbonate, nitrate, chloride, borate, sodium perborate tetrahydrate, sodium perborate monohydrate, phosphate, condensed phosphate, acetate, benzoate, citrate, formate, lactate, malate, tartrate, salicylate, etc. and mixtures thereof can also be used.

Although the preferred ammonium salts can be simply admixed with the detergent composition, they are prone to adsorb water and/or give off ammonia gas. Accordingly, it is better if they are protected in a particle like that described in U.S. Pat. No. 4,652,392, Baginski et al, which is incorporated herein by reference. The preferred ammonium salts or other salts of the specific chlorine scavenger anions can either replace the suds controlling agent or be added in addition to the suds controlling agent.

pH Adjusting Agent

In the instant compositions, one or more buffering agents can be included which are capable of maintaining the pH of the compositions within the desired alkaline range. The pH of the undiluted composition ("as is") is determined at room temperature (about 20° C.) with a pH meter. It is in the low alkaline pH range that optimum performance and stability of the enzyme are realized, and it is also within this pH range wherein optimum compositional chemical and physical stability are achieved.

Maintenance of the composition pH between about 7 and about 11, preferably between about 8 and about 11.5, minimizes undesirable degradation of the active enzymes. Maintenance of this particular pH range also maximizes the soil and stain removal properties and prevents spotting and filming during utilization of the present compositions.

The pH adjusting agents are generally present in a level from about 0.001% to about 25%, preferably from about 0.5% to about 20% by weight of the detergent composition.

Any compatible material or mixture of materials which has the effect of maintaining the composition pH within the pH range of about 7 to about 11, preferably about 8 to about 11, most preferably about 9 to 11, can be utilized as the pH adjusting agent in the instant invention. Such agents can include, for example, various water-soluble, inorganics salts such as the carbonates, bicarbonates, sesquicarbonates, pyrophosphates, phosphates, tetraborates, and mixtures thereof. Silicates are not included because of their high alkaline buffering properties.

Examples of preferred materials which can be used either alone or in combination as the pH adjusting agent herein include sodium carbonate, sodium bicarbonate, potassium carbonate, sodium sequicarbonate, sodium pyrophosphate, tetrapotassium pyrophos- phate, tripotassium phosphate, trisodium phosphate, organic amines and their salts such as monoethanol amine (MEA), anhydrous sodium tetraborate, sodium tetraborate pentahydrate, potassium hydroxide, sodium hydroxide, and sodium tetraborate decahydrate. Combinations of these pH adjusting agents, which include both the sodium and potassium salts, may be used.

Detergent Surfactants

The compositions of this invention can contain from about 0.01% to about 40%, preferably from about 0.1% to about 30% of a detergent surfactant which preferably results in a low foaming detergent composition. Preferably the detergent surfactant is low foaming or which in combination with other components (i.e. suds suppressors) is low foaming. Most preferably the surfactant is a low foaming surfactant. Because the composition is chlorine bleach free, there is no requirement that the surfactant be bleach stable. However, since enzymes are an essential ingredient of the invention, the surfactant employed is preferably enzyme stable (enzyme compatible) and free of enzymatically reactive species. For example, when proteases and amylases are employed, the surfactant should be free of peptide or glycosidic bonds.

Desirable detergent surfactants include nonionic, anionic, amphoteric and zwitterionic detergent surfactants, and mixtures thereof.

Examples of nonionic surfactants include:

(1) The condensation product of 1 mole of a saturated or unsaturated, straight or branched chain, alcohol or fatty acid containing from about 10 to about 20 carbon atoms with from about 4 to about 40 moles of ethylene oxide. Particularly preferred is the condensation product of a fatty alcohol containing from 17 to 19 carbon atoms, with from about 6 to about 15 moles, preferably 7 to 12 moles, most preferably 9 moles, of ethylene oxide provides superior spotting and filming performance. More particularly, it is desirable that the fatty alcohol contain 18 carbon atoms and be condensed with from about 7.5 to about 12, preferably about 9 moles of ethylene oxide. These various specific $C_{17}$-$C_{19}$ ethoxylates give extremely good performance even at lower levels (e.g., 2.5%–3%). At the higher levels (less than 5%), they are sufficiently low sudsing, especially when capped with a low molecular weight ($C_{1-5}$) acid or alcohol moiety, so as to minimize or eliminate the need for a suds-suppressing agent. Suds-suppressing agents in general tend to act as a load on the composition and to hurt long term spotting and filming characteristics.

(2) Polyethylene glycols or polypropylene glycols having molecular weight of from about 1,400 to about 30,000, e.g., 20,000; 9,500; 7,500; 7,500; 6,000; 4,500; 3,400; and 1,450. All of these materials are wax-like solids which melt between 110° F. (43° C.) and 200° F. (93° C.).

(3) The condensation products of 1 mole of alkyl phenol wherein the alkyl chain contains from about 8 to about 18 carbon atoms and from about 4 to about 50 moles of ethylene oxide.

(4) Polyoxypropylene, polyoxyethylene condensates having the formula $HO(C_2H_6O)\ (C_3H_6O)_xH$ or $HO(C_3H_6O)_y(C_2H_4O)_x(C_3H_6O)_yH$ where total y equals at least 15 and total $(C_2H_4O)$ equals 20% to 90% of the total weight of the compound and the molecular weight is from about 2,000 to about 10,000, preferably from about 3,000 to about 6,000. These materials are, for example, the PLURONICS® which are well known in the art.

(5) the compounds of (1) and (4) which are capped with propylene oxide, butylene oxide and/or short chain alcohols and/or short chain fatty acids, e.g., those containing from 1 to about 5 carbon atoms, and mixtures thereof.

Useful surfactants in detergent compositions are those having the formula $RO—(C_2H_4O)_xR^1$ wherein R is an alkyl or alkylene group containing from 17 to 19 carbon atoms, x is a number from about 6 to about 15, preferably from about 7 to about 12, and $R^1$ is selected from the group consisting of: preferably, hydrogen, $C_{1-5}$ alkyl groups, $C_{2-5}$ acyl groups and groups having the formula $—(C_yH_{2y}O)_nH$ wherein y is 3 or 4 and n is a number from one to about 4.

Particularly suitable surfactants are the low-sudsing compounds of (4), the other compounds of (5), and the $C_{17}$-$C_{19}$ materials of (1) which have a narrow ethoxy distribution. Certain of the block co-polymer surfactant compounds designated PLURONIC, PLURAFAC® and TETRONIC® by the BASF Corp., Parsippany, N.J. are suitable as the surfactant for use herein. A particularly preferred embodiment contains from about 40% to about 70% of a polyoxypropylene, polyoxethylene block polymer blend comprising about 75%, by weight of the blend, of a reverse block co-polymer of polyoxyethylene and polyoxypropylene containing 17 moles of ethylene oxide and 44 mole of propylene oxide; and about 25%, by weight of the blend, of a block co-polymer of polyoxyethylene and polyoxypropylene, initiated with tri-methylol propane, containing 99 moles of propylene oxide and 24 moles of ethylene oxide per mole of trimethylol propane.

Additional nonionic type surfactants which may be employed have melting points at or above ambient temperatures, such as octyldimethylamine N-oxide dihydrate, decyldimethylamine N-oxide dihydrate, $C_8$-$C_{12}$ N-methyl-glucamides and the like. Such surfactants may advantageously be blended in the instant compositions with short-chain anionic surfactants, such as sodium octyl sulfate and similar alkyl sulfates, though short-chain sulfonates such as sodium cumene sulfonate could also be used.

In addition to the above mentioned surfactants, other suitable surfactants for detergent compositions can be found in the disclosures of U.S. Pat. Nos. 3,544,473, 3,630,923, 3,88,781 and 4,001,132, all of which are incorporated herein by reference.

Anionic surfactants which are suitable for the compositions of the present invention include, but are not limited to, water soluble-alkyl sulfates and/or sulfonates, containing from about 8 to about 18 carbon atoms. Natural fatty alcohols include those produced by reducing the glycerides of naturally occurring fats and oils. Fatty alcohols can be produced synthetically, for example, by the Oxo process. Examples of suitable alcohols which can be employed in alkyl sulfate manufacture include decyl, lauryl, myristyl, palmityl and stearyl alcohols and the mixtures of fatty alcohols derived by reducing the glycerides of tallow and coconut oil.

Specific examples of alkyl sulfate salts which can be employed in the instant detergent compositions include sodium lauryl alkyl sulfate, sodium stearyl alkyl sulfate, sodium palmityl alkyl sulfate, sodium decyl sulfate, sodium myristyl alkyl sulfate, potassium lauryl alkyl sulfate, potassium stearyl alkyl sulfate, potassium decyl sulfate, potassium palmityl alkyl sulfate, potassium myristyl alkyl sulfate, sodium dodecyl sulfate, potassium dodecyl sulfate, potassium tallow alkyl sulfate, sodium tallow alkyl sulfate, sodium coconut alkyl sulfate, magnesium coconut alkyl sulfate, calcium coconut alkyl sulfate, potassium coconut alkyl sulfate and mixtures thereof. Highly preferred alkyl sulfates are sodium coconut alkyl sulfate, potassium coconut alkyl sulfate, potassium lauryl alkyl sulfate and sodium lauryl alkyl sulfate.

A preferred sulfonated anionic surfactant is the alkali metal salt of secondary alkane sulfonates, an example of which is the Hostapur SAS from Hoechst Celanese.

Another class of suffactants operable in the present invention are the water-soluble betaine surfactants. These materials have the general formula:

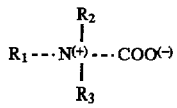

wherein $R_1$ is an alkyl group containing from about 8 to 22 carbon atoms; $R_2$ and $R_3$ are each lower alkyl groups containing from about 1 to 5 carbon atoms, and $R_4$ is an alkylene group selected from the group consisting of methylene, propylene, butylene and pentylene. (Propionate betaines decompose in aqueous solution and hence are not included in the instant compositions).

Examples of suitable betaine compounds of this type include dodecyldimethylammonium acetate, tetradecyldimethylammonium acetate, hexadecyldimethylammonium acetate, alkyldimethylammonium acetate wherein the alkyl group averages about 14.8 carbon atoms in length, dodecyldimethylammonium butanoate, tetradecyldimethylammonium butanoate, hexadecyldimethylammonium butanoate, dodecyl- dimethylammonium hexanoate, hexadecyldimethylammonium hexanoate, tetradecyldiethylammonium pentanoate and tetradecyldipropyl- ammonium pentanoate. Especially preferred betaine surfactants include dodecyldimethylammonium acetate, dodecyldimethylammonium hexanoate, hexadecyldimethylammonium acetate, and hexadecyldi- methylammonium hexanoate.

Other surfactants include amine oxides, phosphine oxides, and sulfoxides. However, such surfactants are usually high sudsing. A disclosure of surfactants can be found in published British Patent Application 2,116,199A; U.S. Pat. No. 4,005,027, Hartman; U.S. Pat. No. 4,116,851, Rupe et at; U.S. Pat. No. 3,985,668, Hartman; U.S. Pat. No. 4,271,030, Brierley et al; and U.S. Pat. No. 4,116,849, Leikhim, all of which are incorporated herein by reference.

Other desirable surfactants are the alkyl phosphonates, taught in U.S. Pat. No. 4,105,573 to Jacobsen issued Aug. 8, 1978, incorporated herein by reference.

Still other preferred anionic surfactants include the linear or branched alkali metal mono- and/or di-($C_{8-14}$) alkyl diphenyl oxide nomo- and/or disulfonates, commercially available under the trade names DOWFAX® 3B-2 (sodium n-decyl diphenyloxide disulfonate) and DOWFAX® 2A-1. These and similar surfactants are disclosed in published U.K. Patent Applications 2,163,447A; 2,163,448A; and 2,164,350A, said applications being incorporated herein by reference.

Detergency Builder

Detergency builders can be added to the present invention in levels from about 0.01% to about 40%, preferably from about 0.1% to about 30%, most preferably from about 2% to about 25% by weight of the composition. The builders reduce the free calcium and/or magnesium ion concentration in a surfactant-containing aqueous solution, enhancing stain removal and providing additional cleaning benefits.

The detergency builder can be any of the detergent builders known in the art which include trisodium phosphate, tetrasodium pyrophosphate, sodium tripolyphosphate, sodium hexametaphosphate, potassium pyrophosphate, potassium tripolyphosphate, potassium hexametaphosphate, sodium carbonate, sodium bicarbonate, sodium hydroxide, borax, sodium nitrilotriacetate, potassium nitrilotriacetate, sodium carboxymethyloxysuccinate, sodium carboxymethyloxymalonate, oxydisuccinate, polyphosphonates, salts of low molecular weight carboxylic acids, such as citrate builders, particularly sodium citrate, and polycarboxylates, such as polyacrylates or polymaleates, copolymers and mixtures thereof.

Other suitable builders include ether carboxylates such as tartrate monodisuccinate and tartrate disuccinate, which can be found in the disclosures of U.S. Pat. Nos. 3,566,984 and 4,663,071, both incorporated herein by reference.

The preferred builder is citric acid or an alkali metal citrate such as sodium citrate in levels from about 2% to about 25%, preferably from about 3% to about 20% by weight of the composition.

Some of the above-described detergency builders additionally serve as buffering (pH adjusting) agents. It is preferred that the buffering agent contain at least one compound capable of additionally acting as a builder.

Organic Dispersant

The present compositions can contain organic dispersant which overcomes the problem of unsightly films which form on china and especially on glassware due to calcium- or magnesium-hardness- induced precipitation of pH-adjusting agents, especially carbonates, used herein.

The organic dispersants herein can be used at levels of 0 to about 20%, typically from about 0.5% to about 17%, most preferably from about 1% to about 15% of the automatic dishwashing composition. Such organic dispersants are preferably water-soluble sodium polycarboxylates. ("Polycarboxylate" dispersants herein generally contain truly polymeric numbers of carboxylate groups, e.g., 8 or more, as distinct from carboxylate builders, sometimes called "polycarboxylates" in the art when, in fact, they have relatively low numbers of carboxylate groups such as four per molecule.) The organic dispersants are known for their ability to disperse or suspend calcium and magnesium "hardness", e.g., carbonate salts. Crystal growth inhibition, e.g., of Ca/Mg carbonates, is another useful function of such materials. Preferably, such organic dispersants are polyacrylates or acrylate-containing copolymers. "Polymeric Dispersing Agents, SOKALAN", a printed publication of BASF Aktiengesellschaft, D-6700 Ludwigshaven, Germany, describes organic dispersants useful herein. Sodium polyacrylate having a nominal molecular weight of about 4500, obtainable from Rohm & Haas under the tradename as ACUSOL® 445N, or acrylate/maleate copolymers such as are available under the tradename SOKALAN®, from BASF Corp., are preferred dispersants herein. These polyanionic materials are, as noted, usually available as viscous aqueous solutions, often having dispersant concentrations of about 30–50%. The organic dispersant is most commonly fully neutralized; e.g., as the sodium salt form.

While the foregoing encompasses preferred organic dispersants for use herein, it will be appreciated that other oligomers and polymers of the general polycarboxylate type can be used, according to the desires of the formulator. Suitable polymers are generally at least partially neutralized in the form of their alkali metal, ammonium or other conventional cation salts. The alkali metal, especially sodium salts, are most preferred. While the molecular weight of such dispersants can vary over a wide range, it preferably is from about 1,000 to about 500,000, more preferably is from about 2,000 to about 250,000, and most preferably is from about 3,000 to about 100,000. Nonlimiting examples of such materials are as follows.

For example, other suitable organic dispersants include those disclosed in U.S. Pat. No. 3,308,067 issued Mar. 7, 1967, to Diehl, incorporated herein by reference. Unsaturated monomeric acids that can be polymerized to form suitable polymeric polycarboxylates include maleic acid (or maleic anhydride), fumaric acid, itaconic acid, aconitic acid, mesaconic acid, citraconic acid and methylenemalonic acid. The presence of monomeric segments containing no carboxylate radicals such as vinylmethyl ether, styrene, ethylene, etc. is suitable, preferably when such segments do not constitute more than about 40% by weight of the polymer.

Other suitable organic dispersants for use herein are copolymers of acrylamide and acrylate having a molecular weight of from about 3,000 to about 100,000, preferably from about 4,000 to about 20,000, and an acrylamide content of less than about 50%, preferably less than about 20%, by weight of the polymer. Most preferably, the polymer has a molecular weight of from about 4,000 to about 10,000 and an acrylamide content of from about 1% to about 15%, by weight of the polymer.

Still other useful organic dispersants include acrylate/maleate or acrylate/fumarate copolymers with an average molecular weight in acid form of from about 2,000 to about 80,000 and a ratio of acrylate to maleate or fumarate segments of from about 30:1 to about 2:1. Other such suitable copolymers based on a mixture of unsaturated mono- and dicarboxylate monomers are disclosed in European Patent Application No. 66,915, published Dec. 15, 1982, incorporated herein by reference. Yet other organic dispersants are useful herein, as illustrated by water-soluble oxidized carbohydrates, e.g., oxidized starches prepared by art-disclosed methods.

Other Optional Materials

The compositions of the present invention may optionally comprise certain esters of phosphoric acid (phosphate ester). Phosphate esters are any materials of the general formula:

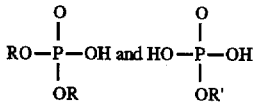

wherein R and R' are $C_6$-$C_{20}$ alkyl or ethoxylated alkyl groups. Preferably R and R' are of the general formula: alkyl—$(OCH_2CH_2)_Y$ wherein the alkyl substituent is $C_{12}$-$C_{18}$ and Y is between 0 and about 4. Most preferably the alkyl substituent of that formula is $C_{12}$-$C_{18}$ and Y is between about 2 and about 4. Such compounds are prepared by known methods from phosphorus pentoxide, phosphoric acid, or phosphorus oxy halide and alcohols or ethoxylated alcohols.

It will be appreciated that the formula depicted represent mono- and di-esters, and commercial phosphate esters will generally comprise mixtures of the mono- and di-esters, together with some proportion of tri-ester. Typical commercial esters are available under the trademarks "Phospholan" PDB3 (Diamond Shamrock), "Servoxyl" VPAZ (Servo), PCUK-PAE (BASF-Wyandotte), SAPC (Hooker). Preferred for use in the present invention are KN340N and KL340N (Hoescht) and monostearyl acid phosphate (Occidental Chemical Corp.). Most preferred for use in the present invention is Hostophat-TP-2253 (Hoescht).

The phosphate esters useful herein provide protection of silver and silver-plated utensil surfaces. The phosphate ester component also acts as a suds suppresser in the anionic surfactant-containing detergent compositions disclosed herein.

If a phosphate ester component is used in the compositions of the present invention, it is generally present from about 0.1% to about 5%, preferably from about 0.15% to about 1.0% by weight of the composition.

Metal salts of long chain fatty acids and/or long chain hydroxy fatty acids have been found to be useful in automatic dishwashing detergent compositions to inhibit tarnishing caused by repeated exposure of sterling or silver-plate flatware to bleach-containing automatic dishwashing detergent compositions (U.S. Pat. No. 4,859,358, Gabriel et at). By "long chain" is meant the higher aliphatic fatty acids or hydroxy fatty acids having from about 6 to about 24 carbon atoms, preferably from about 8 to 22 carbon atoms, and most preferably from about 10 to 20 carbon atoms and most preferably from about 12 to 18, inclusive of the carbon atom of carboxyl group of the fatty acid, e.g., stearic acid, and hydroxy stearic acid. By "metal salts" of the long chain fatty acids and/or hydroxy fatty acids is meant both monovalent and polyvalent metal salts, particularly the sodium, potassium, lithium, aluminum, and zinc salts, e.g., lithium salts of the fatty acids. Specific examples of this material are aluminum, potassium, sodium, calcium and lithium stearate or hydroxy stearate, particularly preferred is aluminum tristearate. If the metal salts of long chain hydroxy fatty acids are incorporated into the automatic dishwashing detergent compositions of the present invention, this component generally comprises from about 0.01% to about 2%, preferably from about 0.05% to about 0.2% by weight of the composition.

An alkali metal salt of an amphoteric metal salt of an amphoteric metal anion (metalate), such as aluminate, can be added to provide additional structuring to the polycarboxylate polymer thickening agent. See U.S. Pat. No. 4,941,988, Wise, issued Jul. 17, 1990, incorporated herein by reference.

Compounds known, or which become known, for reducing or suppressing the formation of suds can be incorporated into the compositions of the present invention. Suitable suds suppressors are described in Kirk Othmer Encyclopedia of Chemical Technology, Third Edition, Volume 7, pages 430–447 (John Wiley & Sons, Inc., 1979), U.S. Pat. No. 2,954,347, issued Sep. 27, 1960 to St. John, U.S. Pat. No. 4,265,779, issued May 5, 1981 to Gandolfo et al., U.S. Pat. No. 4,265,779, issued May 5, 1981 to Gandolfo et al. and European Patent Application No. 89307851.9, published Feb. 7, 1990, U.S. Pat. No. 3,455,839, German Patent Application DOS Suitable nonchlorine bleaches in the present compositions are solid, water-soluble peroxygen compounds in levels from 0 to about 15%, preferably from about 0.2% to about 12% by weight of the composition. Preferred compounds include perborates, persulfates, peroxydisulfates, perphosphates and the crystalline peroxyhydrates. U.S. Pat. No. 2,124,526, U.S. Pat. No. 3,933,672, Bartolotta et at., and U.S. Pat. No. 4,652,392, Baginski et. al., issued Mar. 24, 1987. All are incorporated herein by reference.

The compositions hereof will generally comprise from 0% to about 5% of suds suppressor.

Liquid detergent compositions can contain water and other solvents as carriers. Low molecular weight primary or secondary alcohols exemplified by methanol, ethanol, propanol, and isopropanol are suitable. Monohydric alcohols are preferred for solubilizing surfactant, but polyols such as those containing from 2 to about 6 carbon atoms and from 2 to about 6 hydroxy groups (e.g., propylene glycol, ethylene glycol, glycerine, and 1,2-propanediol) can also be used.

A wide variety of other ingredients useful in detergent compositions can be included in the compositions hereof, including other active ingredients, carriers, hydrotropes, draining promoting agents, processing aids, corrosion inhibitors, perfumes, dyes or pigments, oxygen bleaches, bleach activators, etc.

If present, the above-described other optional materials generally are enzyme compatible and comprise no more than about 10% by weight of the total composition and are dissolved, suspended, or emulsified in the present compositions.

Composition

Preferred viscoeleastic, thixotropic, liquid automatic dishwashing detergent compositions hereof will preferably be formulated such that during use in aqueous operations, the wash water will have a pH of between about 7 and 11, preferably between about 8 and 10.5.

This invention further provides a method for cleaning dishware (i.e. glass, china, flatware, silverware and the like) by contacting the dishware with a liquid detergent composition comprising detersive enzyme, detersive surfactant, viscoelastic thixotropic thickening agent, enzyme stabilizing system, and buffering agent. Agitation is preferably provided for enhanced cleaning.

Preferred herein are gel and/or paste automatic dishwashing detergent compositions, more preferably gel automatic dishwashing detergent compositions. This invention also allows for concentrated gel automatic dishwashing detergent compositions. By "concentrated" is meant that these compositions will deliver to the wash the same amount of active detersive ingredients at a lower dosage.

Concentrated gel automatic detergent compositions herein contain about 10 to 100 weight % more active detersive ingredients than regular gel automatic dishwashing detergent compositions. Preferred are gel automatic dishwashing detergent compositions with from about 10 to 100, preferably 20 to 90, most preferably 25 to 80, weight % of active detersive ingredients.

Conventional methods can be used to prepare the viscoelastic, thixotropic liquid automatic dishwashing detergent compositions herein described. See, for example, U.S. Pat. Nos. 4,824,590, Roselie, issued Apr.25, 1989; U.S. Pat. No. 5,053,158, Dixit et al, issued Oct. 1, 1991, U.S. Pat. No. 4,970,016, Ahmed et al, issued Nov. 13, 1990, U.S. Pat. No. 5,057,237, Drapier et al, issued Oct. 15, 1991 and U.S. Pat. No. 5,078,027, Dixit et al, issued Dec. 24, 1991. A preferred method for preparing a final product of the present invention comprises:

(a) mixing water, enzyme stabilizers and pH adjusting agent under low to medium shear rate;

(b) sequentially adding organic dispersant and builder;

(c) adding under medium shearing a polymer slurry until a desired rheological property is achieved;

(d) adding surfactant and other suitable agents; and (e) sequentially adding enzymes (first one is added and after it is thoroughly mixed any other enzyme may be added in the same manner).

An alternate method is similar to the method herein above; however, the polymer is added after step (d) (adding surfactant and other suitable agents) and before the addition of enzymes. The polymer may be added as either a powder or slurry.

Whichever method is employed, the enzyme stabilizing system should be added prior to the addition of builder. Without being bound by theory, it is believed the enzyme stabilizing system added after the builder will associate with the builder and lose its effectiveness; whereas, if added prior to the builder it will form an effective compound which will not associate with the builder.

In addition, enzymes are added last to minimize degradation due to temperature and pH changes resulting during the process.

All compositions prepared as above described exhibit a viscoelastic, thixotropic nature, and have good phase stability.

Good rheology can be obtained both by the method of formulation and by the use of all sodium components, which this invention allows to be achieved.

The following examples illustrate the compositions of the present invention. All parts, percentages and ratios used herein are by weight unless otherwise specified.

EXAMPLE I

Viscoelastic, thixotropic liquid automatic dishwashing detergent compositions are as follows:

TABLE 1

| | % Weight | | | |
|---|---|---|---|---|
| Ingredients | 1 | 2 | 3 | 4 |
| Sodium citrate | 6.85 | 6.85 | 6.85 | 6.85 |
| Sodium hydroxide (50%) | 1.90 | 1.90 | 1.90 | 1.90 |
| Sodium carbonate | 0.00 | 0.00 | 0.00 | 8.00 |
| Aluminum tristearate | 0.10 | 0.10 | 0.10 | 0.00 |
| Polyacrylate thickener(1) | 1.32 | 1.32 | 2.00 | 2.50 |
| Dye | 0.0016 | 0.0016 | 0.0016 | 0.0016 |
| Perfume | 0.05 | 0.05 | 0.05 | 0.05 |
| Sodium cumene sulfonate | 0.00 | 0.00 | 0.00 | 0.85 |
| Sodium polyacrylate(2) | 2.40 | 2.40 | 2.40 | 2.40 |
| Block co-polymer surfactant(3) | 1.50 | 1.50 | 1.50 | 1.50 |
| Boric acid | 2.00 | 0.00 | 0.00 | 2.00 |
| 1,2-propanediol | 0.00 | 0.00 | 0.00 | 4.70 |
| Calcium formate | 0.00 | 0.20 | 0.20 | 0.00 |
| Sodium formate | 0.00 | 0.45 | 0.45 | 0.00 |
| Protease enzyme(4) | 0.0235 | 0.0235 | 0.0235 | 0.0235 |
| Amylase enzyme(5) | 0.0078 | 0.0078 | 0.0078 | 0.0078 |
| Water and trim | Balance | | | |

(1)Polygel DK, 3-V Chemical Corporation
(2)Molecular weight about 4500
(3)PLURONIC ® 25R2
(4)Esperase 8.0L, Novo Nordisk
(5)MAXAMYL WL 15000

Compositions 1–4 demonstrate the use of various enzyme stabilizing systems, i.e. boric acid (composition 1), boric acid and 1,2-propanediol (composition 4), and calcium/sodium formate (compositions 2 and 3). All exhibit enhanced cleaning, spotting and filming performance and phase stability when stored up to about ten (10) weeks at from about 40° F. (4.4° C.) to about 120° F. (48.9° C.).

EXAMPLE II

Viscoelastic, thixotropic liquid automatic dishwashing detergent compositions are shown below containing chlorine scavengers.

TABLE 2

| | % Weight | | | |
|---|---|---|---|---|
| Ingredients | 5 | 6 | 7 | 8 |
| Sodium citrate | 6.85 | 6.85 | 0.00 | 0.00 |
| Sodium tripolyphosphate | 0.00 | 0.00 | 7.50 | 7.50 |
| Sodium hydroxide (50%) | 1.90 | 1.90 | 1.90 | 1.90 |
| Sodium carbonate | 0.00 | 0.00 | 5.50 | 5.50 |
| Aluminum tristearate | 0.10 | 0.10 | 0.00 | 0.00 |
| Polacrylate thickener(1) | 1.32 | 1.32 | 2.50 | 2.50 |
| Dye | 0.0016 | 0.0016 | 0.0016 | 0.0016 |
| Perfume | 0.05 | 0.05 | 0.05 | 0.05 |
| Sodium cumene sulfonate | 0.00 | 0.00 | 0.85 | 0.85 |
| Sodium polyacrylate(2) | 2.40 | 2.40 | 2.40 | 2.40 |
| Block co-polymer surfactant(3) | 1.50 | 1.50 | 1.50 | 1.50 |
| Sodium n-decydiphenyloxide disulfonate(4) | 0.00 | 0.00 | 1.00 | 0.00 |
| Boric acid | 2.00 | 2.00 | 2.00 | 2.00 |
| 1,2-propanediol | 0.00 | 4.70 | 4.70 | 4.70 |
| Protease enzyme(5) | 0.0236 | 0.0236 | 0.2000 | 0.2000 |
| Amylase enzyme(6) | 0.0078 | 0.0078 | 0.2000 | 0.2000 |
| Lipase enzyme(7) | 0.00 | 0.00 | 0.00 | 0.00 |
| C12–14 fatty acid | 0.00 | 0.00 | 0.50 | 0.00 |
| Monoethanolamine (MEA) | 0.93 | 0.93 | 0.93 | 0.93 |
| Suds suppressor(8) | 0.00 | 0.00 | 0.75 | 0.00 |
| Water and trim | Balance | | | |
| Ingredients | 9 | 10 | 11 | 12 |
| Sodium citrate | 3.00 | 6.85 | 6.85 | 6.85 |
| Sodium tripolyphosphate | 0.00 | 0.00 | 0.00 | 0.00 |

TABLE 2-continued

| | % Weight | | | |
|---|---|---|---|---|
| Sodium hydroxide (50%) | 1.90 | 1.90 | 1.90 | 1.90 |
| Sodium carbonate | 0.00 | 0.00 | 0.00 | 0.00 |
| Aluminum tristearate | 0.00 | 0.00 | 0.00 | 0.00 |
| Polyacrylate thickener(1) | 2.50 | 2.50 | 2.50 | 2.50 |
| Dye | 0.0016 | 0.00 | 0.00 | 0.00 |
| Perfume | 0.05 | 0.05 | 0.05 | 0.05 |
| Sodium cumene sulfonate | 0.85 | 0.85 | 0.85 | 0.85 |
| Sodium polyacrylate(2) | 2.40 | 3.00 | 3.0 | 3.00 |
| Block co-polymer surfactant(3) | 7.00 | 1.50 | 1.50 | 1.50 |
| Sodium n-decydiphenyloxide disulfonate(4) | 0.00 | 0.00 | 0.00 | 0.00 |
| Boric acid | 2.00 | 2.00 | 2.00 | 2.00 |
| 1,2-propanediol | 4.70 | 4.70 | 4.70 | 4.70 |
| Protease enzyme(5) | 0.0235 | 0.10 | 0.10 | 0.50 |
| Amylase enzyme(6) | 0.0078 | 0.00 | 0.10 | 0.00 |
| Lipase enzyme(7) | 0.00 | 0.30 | 0.30 | 0.00 |
| C12–14 fatty acid | 0.00 | 0.50 | 0.50 | 0.50 |
| Monoethanolamine (MEA) | 0.93 | 0.93 | 0.93 | 0.93 |
| Suds suppressor(8) | 0.00 | 0.00 | 0.00 | 0.00 |
| Water and trim | | Balance | | |

(1)Polygel DK, 3-V Chemical Corporation
(2)Molecular weight about 4500
(3)PLURONIC ® 25R2
(4)DOWFAXR 3B2 (45%), BASF Corporation
(5)Esperase 8.0L, Novo Nordisk
(6)MAXAMYL WL 15000
(7)Lipolase 100L Novo-Nordisk
(8)MSAP, Hooker Chemical or LPKN, Knapsack Compositions 5–12 demonstrate the use of chlorine scavengers in viscoelastic, thixotropic liquid automatic dishwashing detergent compositions. All exhibit enhanced cleaning, spotting and filming performance and phase stability when stored up to about ten (10) weeks at from about 40° F. (4.4° C.) to about 120° F. (48.9° C.).

EXAMPLE III

A concentrated, viscoelastic, thixotropic liquid automatic dishwashing detergent composition is as follows:

TABLE 3

| Ingredients | % Weight |
|---|---|
| Citric acid | 11.91 |
| Sodium hydroxide | 9.29 |
| Polyacrylate thickener(1) | 2.50 |
| Dye | 0.0032 |
| Perfume | 0.20 |
| Sodium cumene sulfonate | 1.70 |
| Sodium polyacrylate(2) | 6.00 |
| Block co-polymer surfactant(3) | 3.00 |
| Boric acid | 4.00 |
| 1,2-propanediol | 9.40 |
| Protease enzyme(5) | 0.0472 |
| Amylase enzyme(6) | 0.0156 |
| Water and trim | Balance |

(1)Polygel DK, 3-V Chemical Corporation
(2)Molecular weight about 4500
(3)PLURONIC ® 25R2, BASF Corporation
(5)ESPERASE ® 8.0L, Novo Nordisk
(6)MAXAMYL WL 15000, IBIS (International Biosynthetics Inc.)

EXAMPLE IV

Concentrated gel automatic dishwashing detergent compositions with chlorine scavengers are shown below.

TABLE 4

| | % Weight | | | |
|---|---|---|---|---|
| Ingredients | 14 | 15 | 16 | 17 |
| Citric acid | 11.91 | 12.00 | 0.00 | 0.00 |
| Sodium tripolyphosphate | 0.00 | 0.00 | 15.00 | 15.00 |
| Sodium hydroxide (50%) | 9.29 | 9.30 | 1.90 | 1.90 |
| Polyacrylate thickener(1) | 2.50 | 2.50 | 2.50 | 2.50 |
| Dye | 0.0016 | 0.00 | 0.00 | 0.00 |
| Perfume | 0.20 | 0.05 | 0.05 | 0.05 |
| Sodium cumene sulfonate | 1.70 | 1.70 | 1.70 | 1.70 |
| Sodium polyacrylate(2) | 6.00 | 6.00 | 6.00 | 6.00 |
| Block co-polymer surfactant(3) | 3.00 | 3.00 | 3.00 | 15.00 |
| Sodium n-decydiphenyloxide disulfonate(4) | 0.00 | 2.00 | 2.00 | 0.00 |
| Boric acid | 4.00 | 2.00 | 2.00 | 2.00 |
| 1,2-propanediol | 9.40 | 4.70 | 4.70 | 4.70 |
| Protease enzyme(5) | 0.0472 | 0.05 | 0.05 | 0.05 |
| Amylase enzyme(6) | 0.0156 | 0.02 | 0.02 | 0.02 |
| $C_{12-14}$ fatty acid | 0.00 | 0.50 | 0.50 | 0.50 |
| Monoethanolamine (MEA) | 1.86 | 0.93 | 0.93 | 0.93 |
| Suds suppressor(8) | 0.00 | 0.50 | 0.50 | 0.50 |
| Water and trim | | Balance | | |

(1)Polygel DK, 3-V Chemical Corporation
(2)Molecular weight about 4500
(3)PLURONIC ® 25R2
(4)DOWFAX ® 3B2 (45%), BASF Corporation
(5)Esperase 8.0L, Novo Nordisk
(6)MAXAMYL WL 15000
(8)MSAP, Hooker Chemical or LPKN, Knapsack

EXAMPLE V

Viscoelastic, thixotropic liquid automatic dishwashing detergent compositions are as follows:

TABLE 5

| | % Weight | | | |
|---|---|---|---|---|
| Ingredients | 18 | 19 | 20 | 21 |
| Sodium citrate | 0.00 | 0.00 | 9.00 | 9.00 |
| Sodium hydroxide (50%) | 1.90 | 1.90 | 1.90 | 1.90 |
| Sodium carbonate | 0.00 | 0.00 | 0.00 | 8.00 |
| Aluminum tristearate | 0.10 | 0.10 | 0.10 | 0.00 |
| Polyacrylate thickener(1) | 1.50 | 1.50 | 2.00 | 2.50 |
| Dye | 0.0002 | 0.0002 | 0.0002 | 0.0002 |
| Perfume | 0.05 | 0.05 | 0.05 | 0.05 |
| Sodium cumene sulfonate | 0.00 | 0.00 | 0.00 | 0.85 |
| Sodium polyacrylate(2) | 2.40 | 2.40 | 2.40 | 2.40 |
| Sodium n-decydiphenyloxide disulfonate(3) | 4.00 | 4.00 | 0.00 | 0.00 |
| Boric acid | 2.00 | 0.00 | 0.00 | 2.00 |
| 1,2-propanediol | 0.00 | 0.00 | 0.00 | 4.70 |
| Calcium formate | 0.00 | 0.20 | 0.20 | 0.00 |
| Sodium formate | 0.00 | 0.45 | 0.45 | 0.00 |
| Protease enzyme(4) | 0.02 | 0.02 | 0.02 | 0.02 |
| Amylase enzyme(5) | 0.01 | 0.01 | 0.01 | 0.01 |
| Water and minors | | Balance | | |

(1)Polygel DK, 3-V Chemical Corporation
(2)Molecular weight about 4500
(3)DOWFAXR 3B2
(4)Esperase 8.0L, Novo Nordisk
(5)MAXAMYL WL 15000

What is claimed is:

1. A viscoelastic, thixotropic aqueous, liquid automatic dishwashing detergent composition comprising, by weight:

(a) from about 0.001% to about 5% of an active detersive enzyme or enzymes;

(b) from about 0.1% to about 10% of a viscoelastic thixotropic thickener which is a cross-linked polycarboxylate polymer having a molecular weight of 750,000 to 4,000,00 and which provides an apparent viscosity at high shear of greater than about 250 centipoise and an apparent yield value of from about 40 to about 800 dynes/cm$^2$ to said composition;

(c) from about 0.001% to about 10% of an enzyme stabilizing system selected from the group consisting of calcium ion, propylene glycol, short chain carboxylic acid, polyhydroxyl compounds, boric acid, boronic acid and mixtures thereof;

(d) from about 0.01% to about 40% of a detergent surfactant or a detergent builder or mixtures thereof;

(e) from about 0.001% to about 25% of pH adjusting agent to provide said composition with a product pH between about 7 and about 11 and (f) 0.01% to 0.06% of a chlorine scavenge;

wherein said composition is low foaming and free of chlorine bleach and silicate and wherein said composition is free of clay thickening agents.

2. The composition of claim 1 wherein said enzyme is selected from the group consisting of protease, lipase, amylase and mixtures thereof.

3. The composition of claim 1 comprising from about 0.1% to about 40% of said detergency builder.

4. The composition of claim 3 comprising from about 0.1% to about 30% of said detergent surfactant.

5. The composition of claim 2 comprising from about 0.003% to about 4% of said active detersive enzyme.

6. The composition of claim 4 comprising from about 0.003% to about 4% of said active detersive enzyme.

7. The composition of claim 6 wherein said product pH is between about 8 and about 10.5.

8. The composition of claim 7 wherein said builder is selected from the group consisting of citric acid, alkali metal citrate, alkali metal tripolyphosphate, alkali metal pyrophosphate, oxydisuccinate, polyphosphonates, tartrate monodisuccinate, tartrate disuccinate, alkali metal carbonates, polycarboxylates, and mixtures thereof.

9. The composition of claim 7 wherein said pH adjusting agent is selected from the group consisting of sodium carbonate, sodium bicarbonate, potassium carbonate, sodium sequicarbonate, sodium pyrophosphate, tetrapotassium pyrophosphate, tripotassium phosphate, trisodium phosphate, anhydrous sodium tetraborate, sodium tetraborate pentahydrate, potassium hydroxide, sodium hydroxide, a sodium tetraborate decahydrate, monoethanol amine, triethanol amine, and mixtures thereof.

10. The composition of claim 7 wherein said enzyme stabilizing system is selected from the group consisting of boric acid, 1,2-propanediol, calcium formate, sodium formate and mixtures thereof.

11. The composition of claim 10 comprising from about 0.25% to about 5% of said viscoelastic, thixotropic thickener.

12. The composition of claim 3 wherein said active detersive enzyme is a protease or amylase or mixture thereof.

13. The composition of claim 12 comprising from about 0.005% to about 8% of said enzyme stabilizing system.

14. The composition of claim 10 wherein said surfactant is selected from the group consisting of capped propylene oxide, ethylene oxide block copolymers; condensation products of ethylene oxide and propylene oxide with a mono,-di-, or polyhydroxyl compound with residual hydroxyls capped; alkali metal salts of mono- and/or di-(C8-14) alkyl diphenyl oxide mono- and/or di-sulfonates; $C_{8-18}$ alkyl sulfates; $C_{8-18}$ alkyl sulfonates; and mixtures thereof.

15. The composition of claim 14 comprising from about 0.25% to about 5% of said viscoelastic, thixotropic thickener.

16. The composition of claim 15 wherein said builder is alkali metal citrate or citric acid or mixtures thereof.

17. The composition of claim 15 further comprising an organic dispersant.

18. The composition of claim 17 further comprising from about 0.1% to about 15% of water-soluble peroxygen compounds.

19. The composition of claim 1 wherein said composition is a gel.

20. The composition of claim 17 wherein said composition is a gel.

* * * * *

UNITED STATES PATENT AND TRADEMARK OFFICE

CERTIFICATE OF CORRECTION

PATENT NO. : 5,691,292

DATED : November 25,1997

INVENTOR(S) : Janet Layne Marshall et al.

It is certified that error appears in the above-identified patent and that said Letters Patent is hereby corrected as shown below:

Column 19,line 15 should read --from about 0.01% to about 0.06% of a chlorine scavenger--.

Signed and Sealed this

Eighth Day of June, 1999

*Attest:*

Q. TODD DICKINSON

*Attesting Officer*

*Acting Commissioner of Patents and Trademarks*